US007059496B2

(12) United States Patent
Stern

(10) Patent No.: US 7,059,496 B2
(45) Date of Patent: Jun. 13, 2006

(54) SHAKER

(76) Inventor: Leif Einar Stern, Strandvagen 164, S-234 32, Lomma (SE)

( * ) Notice: Subject to any disclaimer, the term of this patent is extended or adjusted under 35 U.S.C. 154(b) by 0 days.

(21) Appl. No.: 10/488,175

(22) PCT Filed: Aug. 15, 2002

(86) PCT No.: PCT/SE02/01454

§ 371 (c)(1),
(2), (4) Date: Mar. 1, 2004

(87) PCT Pub. No.: WO03/022110

PCT Pub. Date: Mar. 20, 2003

(65) Prior Publication Data

US 2004/0206785 A1 Oct. 21, 2004

(30) Foreign Application Priority Data

Sep. 7, 2001 (SE) ..... 0102964

(51) Int. Cl.
*B67D 5/22* (2006.01)

(52) U.S. Cl. ..... 222/43; 222/306; 222/307; 222/565

(58) Field of Classification Search ..... 222/43, 222/305, 306, 307, 308, 565
See application file for complete search history.

(56) References Cited

U.S. PATENT DOCUMENTS

| | | | | |
|---|---|---|---|---|
| 1,682,804 A | | 9/1928 | Searight | |
| 2,252,835 A | | 8/1941 | Chenette | |
| 4,071,171 A | * | 1/1978 | Bassignani | 222/305 |
| 4,322,017 A | * | 3/1982 | Lowdermilk | 222/43 |
| 5,429,281 A | | 7/1995 | Sellers | |
| 5,645,197 A | * | 7/1997 | Chen | 222/305 |
| 5,676,282 A | * | 10/1997 | Satterfield | 222/307 |

FOREIGN PATENT DOCUMENTS

| | | |
|---|---|---|
| DE | 25 28 006 A1 | 12/1976 |
| DE | 25 57 715 A1 | 6/1977 |
| WO | WO-03/022110 A1 | 3/2003 |

* cited by examiner

*Primary Examiner*—Joseph A. Kaufman
(74) *Attorney, Agent, or Firm*—Tarolli, Sundheim, Covell & Tummino L.L.P.

(57) ABSTRACT

The present invention relates to a shaker for sprinkling granules, preferably salt. The shaker (1) comprises a screen-like member (7) which is mounted movable in vertical direction relative to such lower parts (5) of the shaker (1) which define a lower space (8) in which granules (2) are collected or vice versa, for being able to set the screen-like member (7) such that downwardly directed portions (7*a*) thereof can be set at different distances (e.g. A or B) from the bottom (9) of the lower space (8). Thereby, it is achieved that the lower space (8) can be brought to contain different amounts of granules (2).

22 Claims, 4 Drawing Sheets

SHAKER

BACKGROUND OF THE INVENTION

Shakers of the abovementioned type are already known from e.g. U.S. Pat. Nos. 1,682,804, 2,252,835 and 5,429,281. None of these prior art shakers permits variation of the amount of granules sprinkled at each sprinkling occasion.

FIELD OF THE INVENTION

The present invention relates to a shaker for sprinkling granules, preferably salt. The shaker comprises upper parts defining at least one supply space for granules and lower parts with at least one outfeed opening for sprinkling granules out of the shaker in a downward direction by imparting sprinkling movements to the shaker. At the bottom of the shaker there is provided at least one screen-like member forming a bottom for the supply space and covering the outfeed opening. The lower parts of the shaker define at least one lower space which is located around the outfeed opening and the lower space is closed down below by means of the bottom and is provided at the top with an upper opening. Downwardly directed portions of the screen-like member are directed downwards towards and preferably into the lower space. The lower space communicates via a through-flow gap at an outer side of the downwardly directed portions of the screen-like member with the supply space such that granules can flow from said supply space down into the lower space. The lower space communicates via a discharge gap, which relative to a centre line along the shaker is located at an inner side of said downwardly directed portions, with the outfeed opening such that granules via the discharge gap can pass from the lower space to the outfeed opening.

SUMMARY OF THE INVENTION

The object of the present invention has been to improve prior art shakers such that the amount of granules sprinkled at each sprinkling occasion can be varied. Since the screen-like member of the shaker is movable relative to a lower space, it is possible to bring the lower space to contain different amounts of granules. The farther down the screen-like member is set, the smaller amount of granules can be accommodated in the lower space and the farther up the screen-like member is set, the larger amount of granules can be accommodated in the lower space.

BRIEF DESCRIPTION OF THE DRAWINGS

The invention will be further described below with reference to the accompanying drawings, in which.

DESCRIPTION OF EXAMPLE EMBODIMENTS

Figure 1:
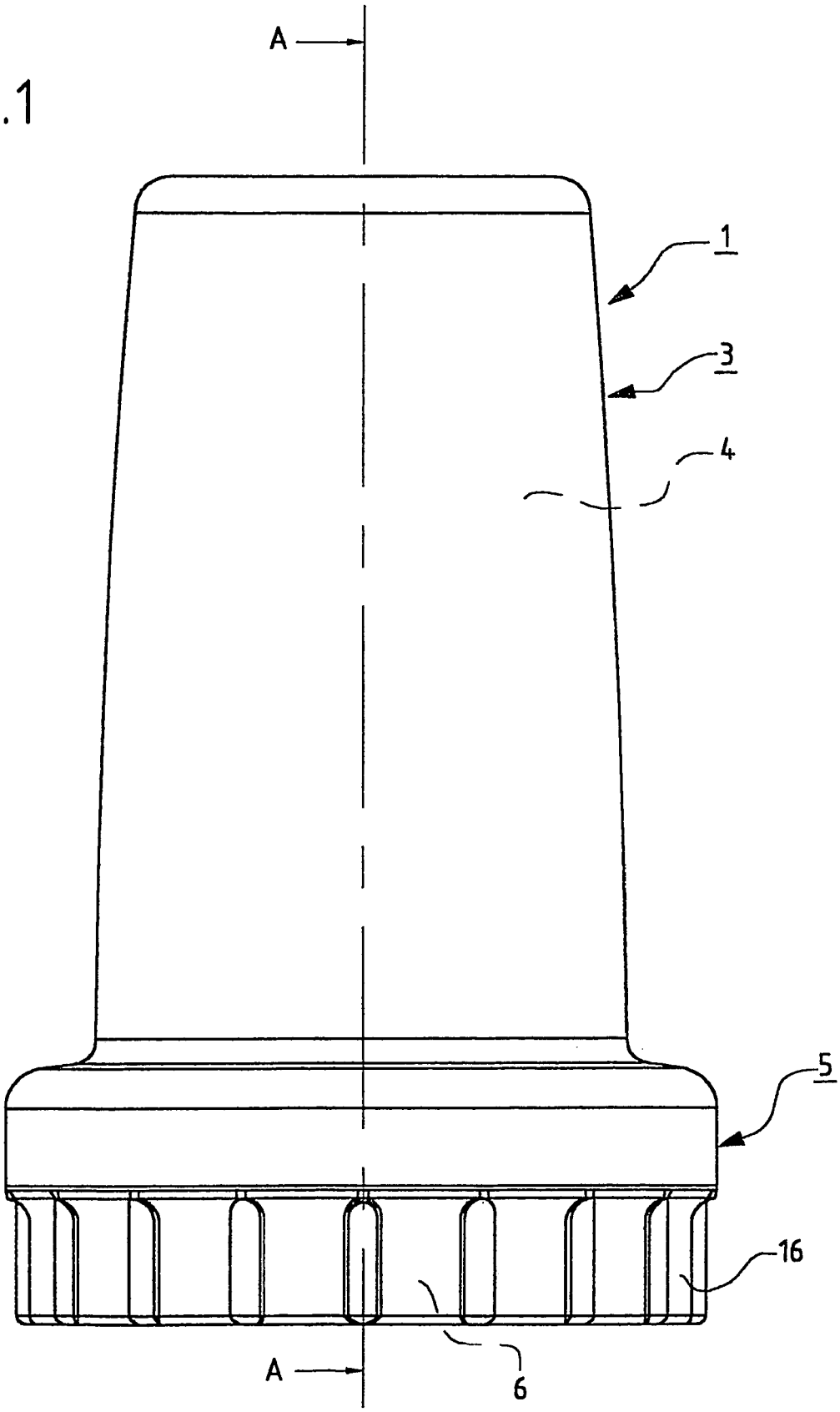
FIG. 1 is a side view of a shaker according to the invention.
Figure 2:
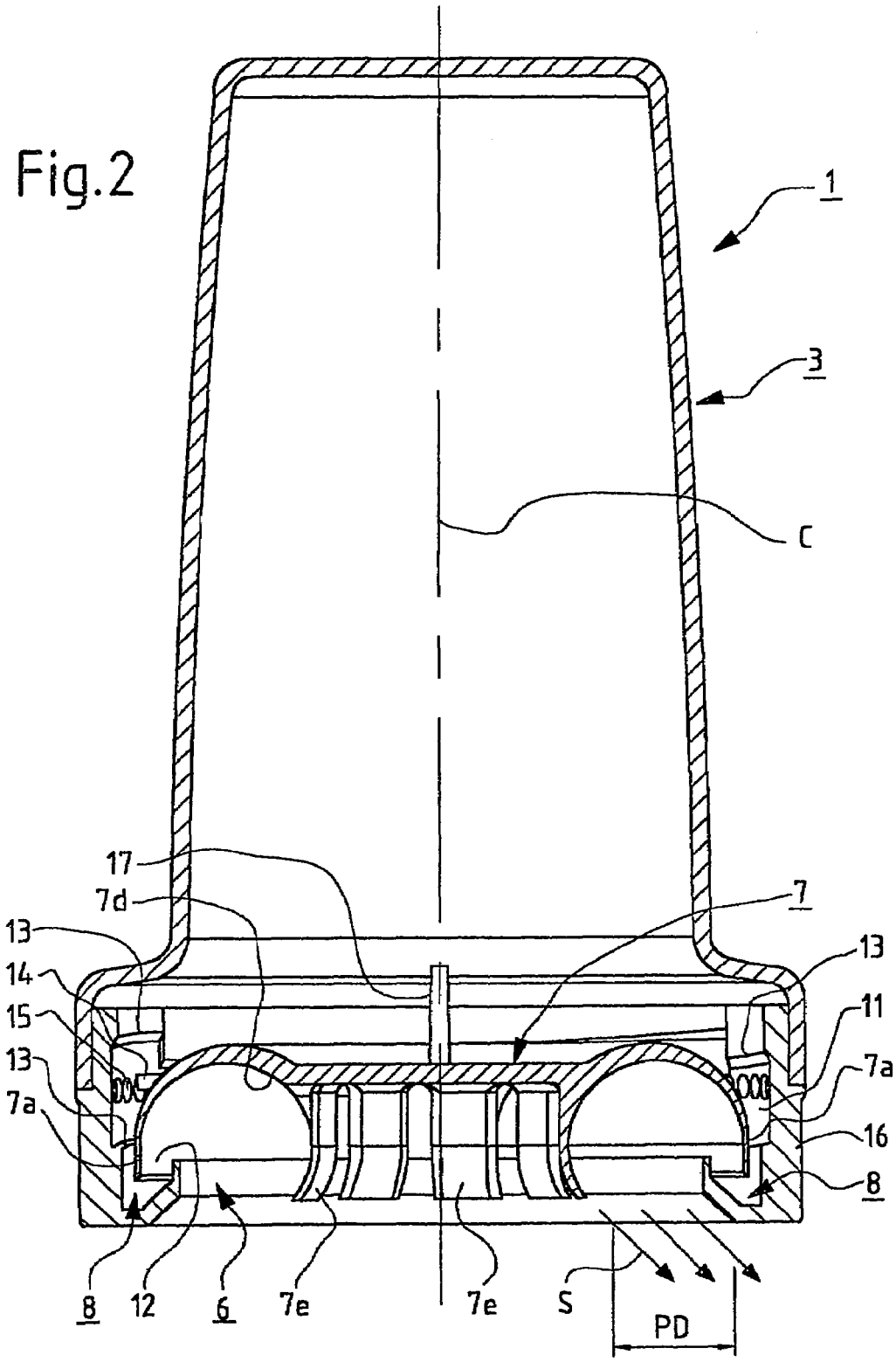
FIG. 2 is a section along the line A—A through the shaker of FIG. 1.
Figure 3:
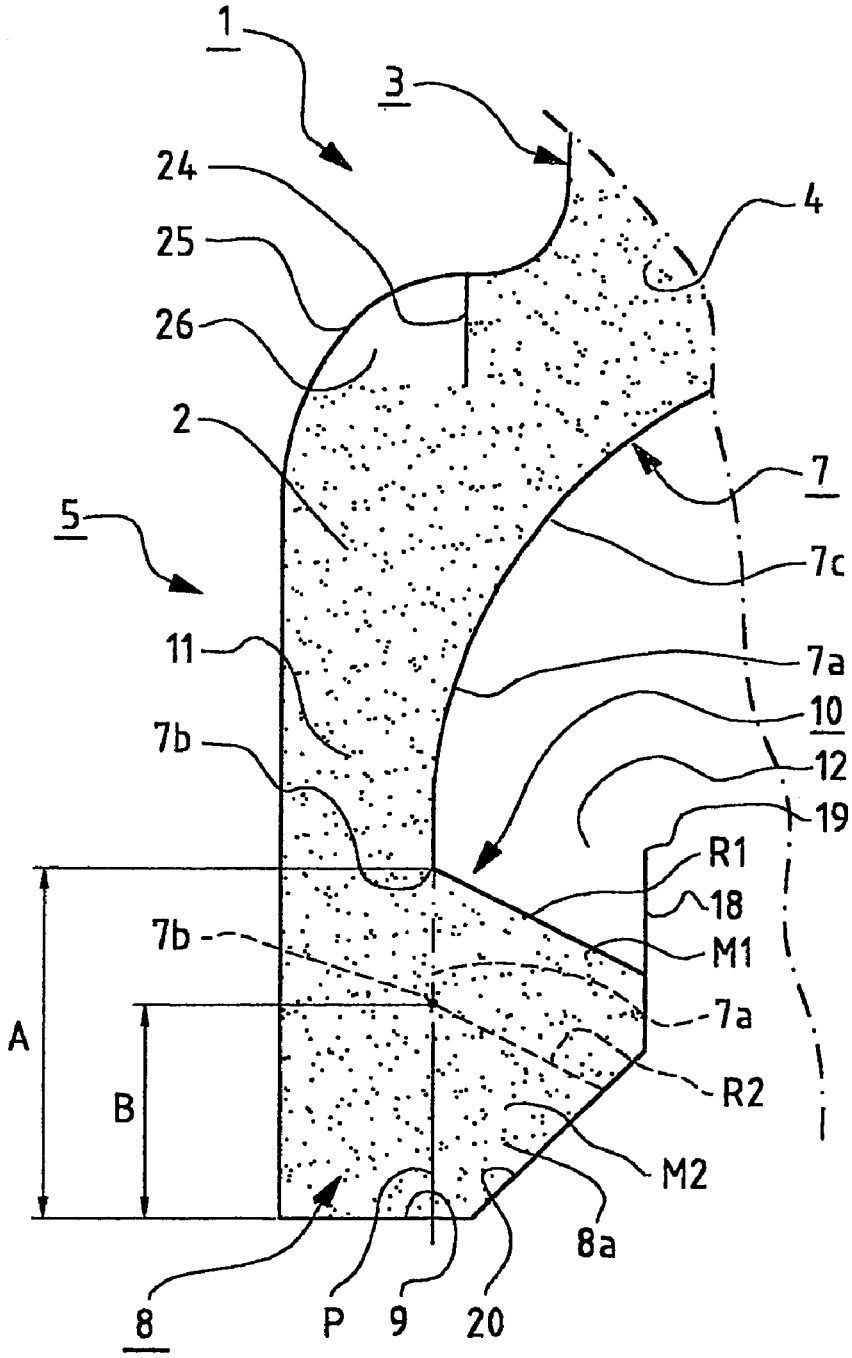
FIG. 3 illustrates schematically an enlarged portion of lower parts with a lower space of the shaker of FIG. 1.

The embodiment of the shaker 1 according to the invention illustrated in FIGS. 1–3, is adapted for sprinkling granules 2, preferably salt, on foodstuff. Said shaker 1 comprises upper parts 3, defining at least one supply space 4 for the granules 2, and lower parts 5 with at least one outfeed opening 6 for sprinkling granules 2 out of the shaker 1 in a downward direction. This is done by imparting sprinkling movements to the shaker 1, normally a first movement upwards and then a movement downwards, at each sprinkling occasion.

At the bottom of the shaker 1 there is provided at least one screen-like member 7 forming a bottom for the supply space 4 and covering the outfeed opening 6 such that granules 2 can not unintentionally fall out of said supply space 4.

The lower parts 5 of the shaker 1 define at least one lower space 8 which is located around the outfeed opening 6 and which is closed down below by means of a bottom 9 and having an upper opening 10. The screen-like member 7 has downwardly directed portions 7*a* which are directed downwards towards and preferably into the lower space 8.

The lower space 8 communicates via a through-flow gap 11 at an outer side of said downwardly directed portions 7*a* with the supply space 4 such that granules 2 can flow from said supply space 4 down into the lower space 8.

The lower space 8 communicates via a discharge gap 12, which relative to a centre line C which runs along the shaker 1 is located at an inner side of the downwardly directed portions 7*a*, with the outfeed opening 6 such that granules 2 via the discharge gap 12 can pass from the lower space 8 to the outfeed opening 6.

In order to see to that the lower space 8 can contain different amounts of granules, the screen-like member 7 is mounted movable in vertical direction relative to the lower parts 5 defining the lower space 8, or are said lower parts 5 instead mounted movable in vertical direction relative to the screen-like member 7. Thus, the screen-like member 7 can be set at different heights between an upper position (shown with solid lines in FIG. 3) in which a lower edge 7*b* of the downwardly directed portions 7*a* is situated at a distance A from the bottom 9 of the lower space 8, and a lower position (shown with broken lines in FIG. 3) in which the downwardly directed portions 7*a* are situated at a smaller distance B from said bottom 9.

If the screen-like member 7 is set e.g. in the upper position at the distance A from the bottom 9, the granules 2 will be filled into the lower space 8 until an inner pocket 8*a* thereof has been filled up to the lower edge 7*b* from which it is sloping downwards/inwards at an angle of repose R1. If this pocket 8*a* is limited in outwards direction by an imaginary vertical plane P, an amount M1 will in said case be collected or gathered in the pocket 8*a* beneath the discharge gap 12 and this amount M1 will be brought to leave the lower space 8 at a sprinkling occasion. If the screen-like member 7 instead is set at a lower level, e.g. in the lower position at the distance B from the bottom 9, granules 2 will be filled into the lower space 8 until the inner pocket 8*a* has been filled up to the lower edge 7*b*, but since this lower edge 7*b* in said latter position is situated closer to the bottom 9, a smaller amount M2 will be gathered or collected in the pocket 8*a*, and this smaller amount of granules 2 will slope downwards/inwards at an angle of repose R2 (shown with broken lines in FIG. 3). In said latter case the smaller amount M2 may thus be sprinkled at a sprinkling occasion.

In the same manner various amounts of granules 2 (which are smaller than the amount M1 and larger than the amount M2) can be gathered or collected in the inner pocket 8*a*.

Thus, the abovementioned possibility to gather or collect a sprinkable amount of granules 2 set for each sprinkling occasion in the pocket 8*a*, has the advantage that one can determine exactly the amount of granules 2 to be sprinkled or spread at each sprinkling occasion. Setting the screen-like member 7 in different positions relative to the lower space 8 further means that the amount sprinkled at each sprinkling occasion can be varied.

The screen-like member 7 can be set in vertical direction by imparting thereto a rotary motion relative to the lower parts 5 defining the lower space 8.

Thus, the lower parts 5 of the shaker 1 may have at least one helical groove 13 which is rotatably engaged by the screen-like member 7.

For being able to set the screen-like member 7 in various definite height or vertical positions, said screen-like member and the lower parts 5 of the shaker 1 may be provided with co-operating stepping members which permit step-wise rotation of the screen-like member 7 relative to said lower parts 5. These stepping members may consist of flanges 14 which are provided, directed outwardly, on the screen-like member 7, and these flanges 14 may co-operate with a rim of projections 15 located on the inner side of the lower parts 5.

The lower parts 5 of the shaker 1 defining the lower space 8 may be an annular member 16 which is removably attached to the upper parts 3 of the shaker 1. The annular member 16 can be attached by a snap-in action or screwed onto the upper parts 3.

The screen-like member 7 may on an upper side have at least one flange 17 which is accessible when the annular member 16 has been removed from the upper parts 3 of the shaker 1 together with the screen-like member 7 for being able to grip or engage the flange 17 and thereby rotate the screen-like member 7 relative to the annular member 16 and in this way set said screen-like member 7 in different height or vertical positions relative to the lower space 8.

An alternative embodiment may be that on the screen-like member 7 there are downwardly directed means which can be grasped or engaged via the outfeed opening 6 for rotation of the screen-like member 7 relative to the lower parts 5, whereby height adjustment of said screen-like member 7 may occur relative to the lower space 8 without having to dismount or take the shaker 1 apart.

At the embodiments of the shaker 1 illustrated in the figures, the lower space 8 may be limited in inwards direction (relative to the longitudinal centre line C through the shaker 1) by an inner wall 18, the upper edge 19 of which defines upper portions of the outfeed opening 6. Also, at least lower portions of an inner side 20 of the inner wall 18, closest to said bottom 9 of the lower space 8, may be directed obliquely upwards/inwards.

At the shaker 1 shown, the screen-like member 7 may transform, via arcuate portions 7*c*, into the downwardly directed portions 7*a*. The bottom side of these arcuate portions 7*c* may define sliding surfaces along which the granules 2 slide when they are thrown out of the lower space 8.

On and/or beneath the screen-like member 7 or on other suitable locations there may be spreading surfaces and/or spreading members for spreading or scattering the granules 2 coming from the lower space 8 in, inter alia, outwards direction (i.e. in the spreading direction S) relative to the centre line C, such that the granules 2 are spread out over an area beneath the shaker 1 which is not too limited. These spreading surfaces and/or spreading members may be located and designed in various ways. In the embodiment of FIG. 2, certain such spreading surfaces and spreading members are shown, while in the embodiment of FIG. 4 other spreading surfaces and spreading members are shown. Thus, the embodiment of FIG. 2 illustrates spreading members 21 which are defined by a downwardly directed extension 7*d* of the screen-like member 7. Within said extension 7*d* there is located a rim of downwardly and down below, outwardly directed spreading members 7*e*. These are adapted to spread or scatter downwardly flowing granules 2 in downwards direction through peripheral portions PD of the outfeed opening 6. Some of the granules 2 may flow in inwards/downwards direction through spaces between said spreading members 7*e*.

Figure 4:
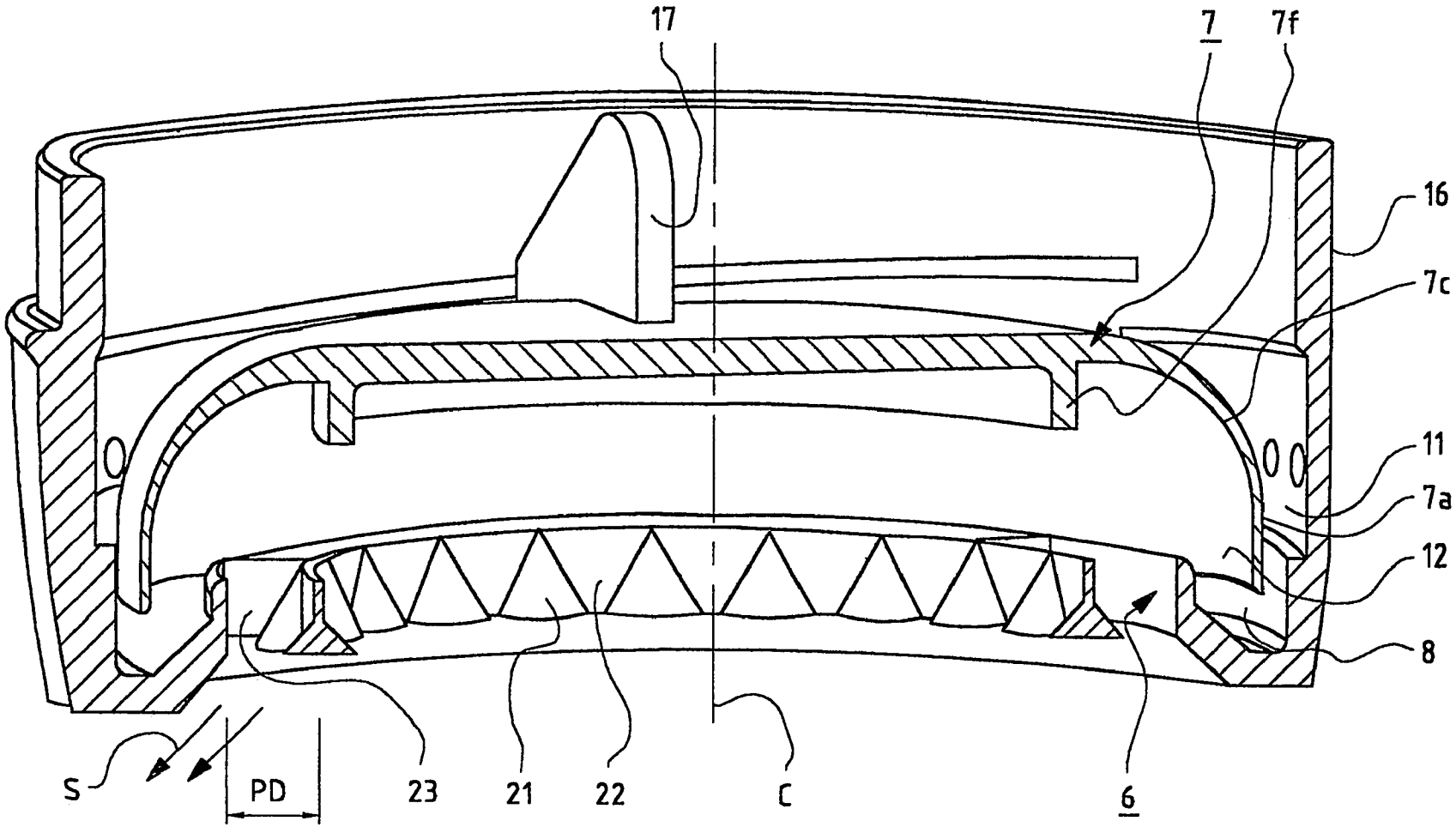
FIG. 4 illustrates with a section lower parts of an alternative embodiment of the shaker according to the invention.

At the embodiment of FIG. 4, the screen-like member 7 has, within the arcuate portions 7*c*, a downwardly directed spreading member in the form of a downwardly directed, annular flange 7*f* which directs the flow of granules through said peripheral portions PD of the outfeed opening 6. In said peripheral portions PD of the outfeed opening 6 there are provided or located spreading members 21 for spreading the granules 2 flowing downwards through said peripheral portions PD, in a direction downwards/outwards and downwards/inwards. These spreading members 21 may e.g. be conical in shape and be located with the point facing upwards. They may be located in a rim on a ring 22 and this ring 22 may be attached to the inner wall 18 via mounting ears 23. The annular flange 7*f* may have a somewhat smaller diameter than the outfeed opening 6 and the ring 22 may have a smaller diameter than the outfeed opening 6 but a larger diameter than the annular flange 7*f*.

A sprinkling occasion can mean that the shaker 1 initially is lifted quickly in vertically upwards direction. Due to this lifting movement, the amount of granules 2 (e.g. the amount M1 or M2) will be thrown upwards out of the pocket 8*a*, while those portions of the granules 2 located in an outer part of the lower space 8 on the outside of said plane P will be thrown upwards in the through-flow gap 11, which however can be prevented by providing a flow resisting member 24 in the upper parts 3, e.g. above the through-flow gap 11. This flow resisting member 24 may be a downwardly directed, annular flange, which, with an inwardly directed wall portion 25 of the upper parts 3 vertically above the through-flow gap 11, defines a downwards open but upwards closed space 26 in which granules 2 are prevented from being thrown upwards and eventually into the supply space 4 when the shaker 1 is quickly lifted. Hereby, there are granules 2 near the pocket 8*a* which quickly can fill said pocket 8*a* after a quick lifting movement of the shaker 1.

At said sprinkling occasion, the shaker 1 may, after quick lifting thereof, be lowered quickly in a vertically downwards direction. Hereby, the amount of granules 2 which during the initial lifting movement is thrown out of the inner pocket 8*a* will be thrown downwards by the screen-like member 7. At e.g. the embodiment of FIG. 4, the granules 2 will be thrown towards the spreading members 21 by means of the screen-like member 7 and will be spread or scattered, inter alia, obliquely outwards in the spreading direction S relative to said centre line C, by said spreading members 21.

Thereafter, said sprinkling occasion is concluded and a certain amount of granules has been spread or sprinkled over an area which is not limited to parts having a substantially smaller diameter than the outfeed opening 6, but on the contrary preferably has a larger diameter than said outfeed opening 6.

The invention is not limited to the embodiments described above and shown in the drawings. As examples of other embodiments of the shaker 1 it should be noted that the shaker 1 may consist of another number than three members even if it is preferred that the shaker consists of three members. The spreading surfaces or spreading members may be located and/or designed in other ways. The upper parts 3 of the shaker 1 may at least in part be made of a transparent material so that you can see how much granule material there is in the supply space 4, the shaker 1 may be used for other granules than salt and it may consist of a suitable plastic material. Furthermore, there may be a setting scale (not shown) showing in which height or vertical position the screen-like member 7 is set relative to the lower space 8. There may also be a direction indicator showing in which direction a member 16 of the shaker 1 shall be screwed or rotated for raising or lowering said member 16.

The invention claimed is:

1. A shaker for sprinkling granules, said shaker comprising:

upper parts (3) defining at least one supply space (4) for granules;

lower parts (5) with at least one outfeed opening (6) for sprinkling granules (2) out of said shaker (1) in a downward direction by imparting sprinkling movements to the shaker (1);

at least one screen-like member (7) located at the bottom of the shaker (1), said screen-like member (7) forming a bottom for the supply space (4) and covering said outfeed opening (6);

wherein said lower parts (5) of the shaker (1) define at least one lower space (8) which is located around said outfeed opening (6), said lower space (8) being closed down below by a bottom portion (9) and is provided at the top with an upper opening (10), said screen-like member (7) including downwardly directed portions (7*a*), said downwardly directed portions (7*a*) being directed downwards towards said lower space (8), a through-flow gap (11) located at an outer side of said downwardly directed portions (7*a*), wherein said lower space (8) communicates with the supply space (4) via said through-flow gap (11) such that granules (2) can flow from said supply space (4) down into the lower space (8), a discharge gap (12), which relative to a centre line (C) along said shaker (1) is located at an inner side of said downwardly directed portions (7*a*), said lower space (8) communicating with said outfeed opening (6) via said discharge gap (12) such that the granules (2) via the discharge gap (12) can pass from said lower space (8) to said outfeed opening (6), and characterized in that said screen-like member (7) is mounted movable in a vertical direction relative to said lower parts (5) of the shaker (1) which define said lower space (8) or vice versa, for being able to set said screen-like member (7) such that said downwardly directed portions (7*a*) are set at different distances (e.g. A or B) from said bottom portion (9) of said lower space (8) so that said lower space (8) can be brought to contain different amounts (e.g. M1 or M2) of granules (2).

2. The shaker according to claim 1, characterized in that said downwardly directed portions (7*a*) of said screen-like member (7) are directed downwards towards said lower space (8) such that within an imaginary vertical plane (P) and beneath said discharge gap (12) there is defined an inner pocket (8*a*) of said lower space (8), wherein an amount (M1 or M2) of granules (2) is collected in said inner pocket (8*a*) for sprinkling on one and the same sprinkling occasion.

3. The shaker according to claim 1 including a flow resisting member (24) to prevent granules (2) from being thrown out of said lower space (8) upwards into said through-flow gap (11).

4. The shaker according to claim 3, characterized in that said flow resisting member (24) is located on an inwardly directed wall portion (25) of said upper parts (3) of said shaker (1) such that said flow resisting member (24) along with said inwardly directed wall portion (25) defines a flange extending downward toward said through-flow gap (11) defining a closed space (26) above said through-flow gap (11).

5. The shaker according to claim 1, characterized in that said shaker (1) has one of spreading surfaces and spreading members (7*d* or 7*e* or 7*f* or 21) provided to spread or scatter granules (2) in an outwards direction relative to said centre (c) line of said shaker (1).

6. The shaker according to claim 5, characterized in that one of said spreading surfaces and said spreading members (7*d* or 7*e* or 7*f* or 21) are located on said screen-like member (7) or on said lower parts (5) of said shaker (1) beneath said screen-like member (7).

7. The shaker according to claim 6, characterized in that said screen-like member (7) has at least one of said spreading members (7*d* or 7*e* or 7*f* or 21) guiding granules (2) to pass through peripheral portions (PD) of said outfeed opening (6).

8. The shaker according to claim 7, characterized in that said spreading members (21) are defined by an annular flange (7*f*) which is directed downwards from said screen-like member (7) and which direct the granules (2) to flow through said peripheral portions (PD) of said outfeed opening (6).

9. The shaker according to claim 8, characterized in that said annular flange (7*f*) has an outer diameter which is smaller than a diameter of said outfeed opening (6).

10. The shaker according to claim 8, characterized in that said spreading members (21) spread the granules (2) at least in obliquely outwards and obliquely inwards directions, said spreading members (21) located in said peripheral portions (PD) of said outfeed opening (6) through which the granules (2) are brought to pass.

11. The shaker according to claim 10, characterized in that a rim of said spreading members (21) is located in said peripheral portions (PD) through which the granules (2) pass, and that said rim has a diameter which is larger than a diameter of the annular flange (7*f*) but smaller than a diameter of the said outfeed opening (6).

12. The shaker according to claim 10, characterized in that said spreading members (21) are conical in shape and have points facing upwards.

13. The shaker according to claim 12, characterized in that said conical members (21) form part of a ring (22) which is located in said outfeed opening (6).

14. The shaker according to claim 6, characterized in that said spreading surfaces (7*d* or 7*e* or 7*f*) on said screen-like member (7) limit movement of the granules (2) in an inward direction when the granules (2) are thrown out of said lower space (8) by imparting a sprinkling movement in the upward direction to said shaker (1), and said screen-like member (7) affecting the granules (2) in a downwards direction towards said spreading members (21) beneath said screen-like member (7) when said shaker (1) is imparted a sprinkling movement in the downwards direction.

15. The shaker according to claim 1, characterized in that said shaker (1) consists of only three parts, said three parts being said upper part (3) with said supply space (4), an annular member (16) defining said lower space (8), and said screen-like member (7), said annular member (16) being removably attached to said upper part (3), and said screen-like member (7) being removably attached to said annular member (16).

16. The shaker according to claim 1, characterized in that said screen-like member (7) can be set in a vertical direction by imparting thereto a rotary motion relative to said lower parts (5) defining said lower space (8) of said shaker (1).

17. The shaker according to claim 16, characterized in that said screen-like member (7) and said lower parts (5) of said shaker (1) define said lower space (8) provided with co-operating stepping members (14, 15) which permit step-wise rotation of said screen-like member (7) to different definite positions relative to said lower parts (5) of said shaker (1).

18. The shaker according to claim 16, characterized in that said lower parts (5) of said shaker (1) define said lower space (8) having at least one helical groove (13) which is rotatably engaged by said screen-like member (7).

19. The shaker according to claim 16, characterized in that said lower parts (5) of said shaker (1) define said lower space (8), having an annular member (16) which is removably attached to said upper parts (3) of said shaker (1), and that said screen-like member (7) has at least one flange (17) on an upper side of said screen-like member (7), said flange (17) being accessible when said annular member (16) has been removed from said upper parts (3) of said shaker (1), wherein said flange (17) is accessible along with said screen-like member (7) for gripping or engaging said flange (17) and thereby is able to rotate said screen-like member (7) relative to said annular member (16).

20. The shaker according to claim 16, further including downwardly directed means on said screen-like member (7) which can be grasped or engaged through said outfeed opening (6) for rotation of said screen-like member (7) relative to said lower parts (5) of said shaker (1) defining said lower space (8).

21. The shaker according to claim 1, characterized in that said lower space (8) is limited in an inward direction by an inner wall (18), said inner wall including an upper edge (19) defining upper portions of said outfeed opening (6), and that at least lower portions of an inner side (20) of said inner wall (18) are nearest said bottom portion (9) of said lower space (8) and are directed obliquely upwardly and inwardly.

22. The shaker according to claim 1, characterized in that said shaker (1) has a setting scale showing in which height position said screen-like member (7) is set relative to said lower space (8) and a direction indicator showing in which direction a member (16) of said shaker (1) shall be screwed or rotated for raising or lowering said member (16).

* * * * *